US006917268B2

(12) United States Patent
Deligianni et al.

(10) Patent No.: US 6,917,268 B2
(45) Date of Patent: Jul. 12, 2005

(54) LATERAL MICROELECTROMECHANICAL SYSTEM SWITCH

(75) Inventors: Hariklia Deligianni, Tenafly, NJ (US); Christopher V. Jahnes, Upper Saddle River, NJ (US); Jennifer L. Lund, Amawalk, NY (US); Lawrence E. Larson, Del Mar, CA (US)

(73) Assignee: International Business Machines Corporation, Armonk, NY (US)

( * ) Notice: Subject to any disclaimer, the term of this patent is extended or adjusted under 35 U.S.C. 154(b) by 202 days.

(21) Appl. No.: 10/035,840

(22) Filed: Dec. 31, 2001

(65) Prior Publication Data

US 2003/0122640 A1 Jul. 3, 2003

(51) Int. Cl.[7] ..... H01H 51/22
(52) U.S. Cl. ..... 335/78; 200/181
(58) Field of Search ..... 335/78; 200/181; 361/230–235; 257/412–418, 424, 427

(56) References Cited

U.S. PATENT DOCUMENTS

| | | | | |
|---|---|---|---|---|
| 5,578,976 A | | 11/1996 | Yao | |
| 5,619,061 A | | 4/1997 | Goldsmith et al. | |
| 6,020,564 A | | 2/2000 | Wang et al. | |
| 6,072,686 A | | 6/2000 | Yarbrough | 361/234 |
| 6,075,239 A | | 6/2000 | Aksyuk et al. | |
| 6,094,102 A | | 7/2000 | Chang et al. | |
| 6,100,477 A | | 8/2000 | Randall et al. | |
| 6,144,545 A | * | 11/2000 | Lee et al. | 361/233 |
| 6,218,911 B1 | | 4/2001 | Kong et al. | |
| 6,232,847 B1 | | 5/2001 | Marcy, 5th et al. | |
| 6,307,452 B1 | * | 10/2001 | Sun | 333/262 |
| 6,506,989 B2 | * | 1/2003 | Wang | 200/181 |

FOREIGN PATENT DOCUMENTS

| | | |
|---|---|---|
| JP | 2001084884 A1 | 3/2001 |
| WO | WO 0135433 A2 | 5/2000 |

OTHER PUBLICATIONS

Docket No. FIS920000324US1, Ser. No. 09/727,165, Filing Date Nov. 30, 2000, Petrarca, et al., Multiposition Micro Electromechanical Switch.

* cited by examiner

*Primary Examiner*—Lincoln Donovan
(74) *Attorney, Agent, or Firm*—Joseph P. Abate

(57) ABSTRACT

A switch comprising a substrate, an elongated movable part, a pair of electrical contacts disposed at one side of said part, an actuation electrode disposed at the one side of the part and separated from the pair of electrical contacts, wherein the part, the contacts and the electrode are disposed on the substrate, wherein the elongated movable part is arranged and dimensioned such that the part is movable in a generally lateral direction toward the contacts; the movable part includes a central elongated member fixed to a head having an electrical contact disposed at the one side. One end of the movable part is attached to the substrate by means of various anchoring arrangements.

14 Claims, 7 Drawing Sheets

LATERAL MICROELECTROMECHANICAL SYSTEM SWITCH

BACKGROUND OF THE INVENTION

1. Field of the Invention

Figure 1A:
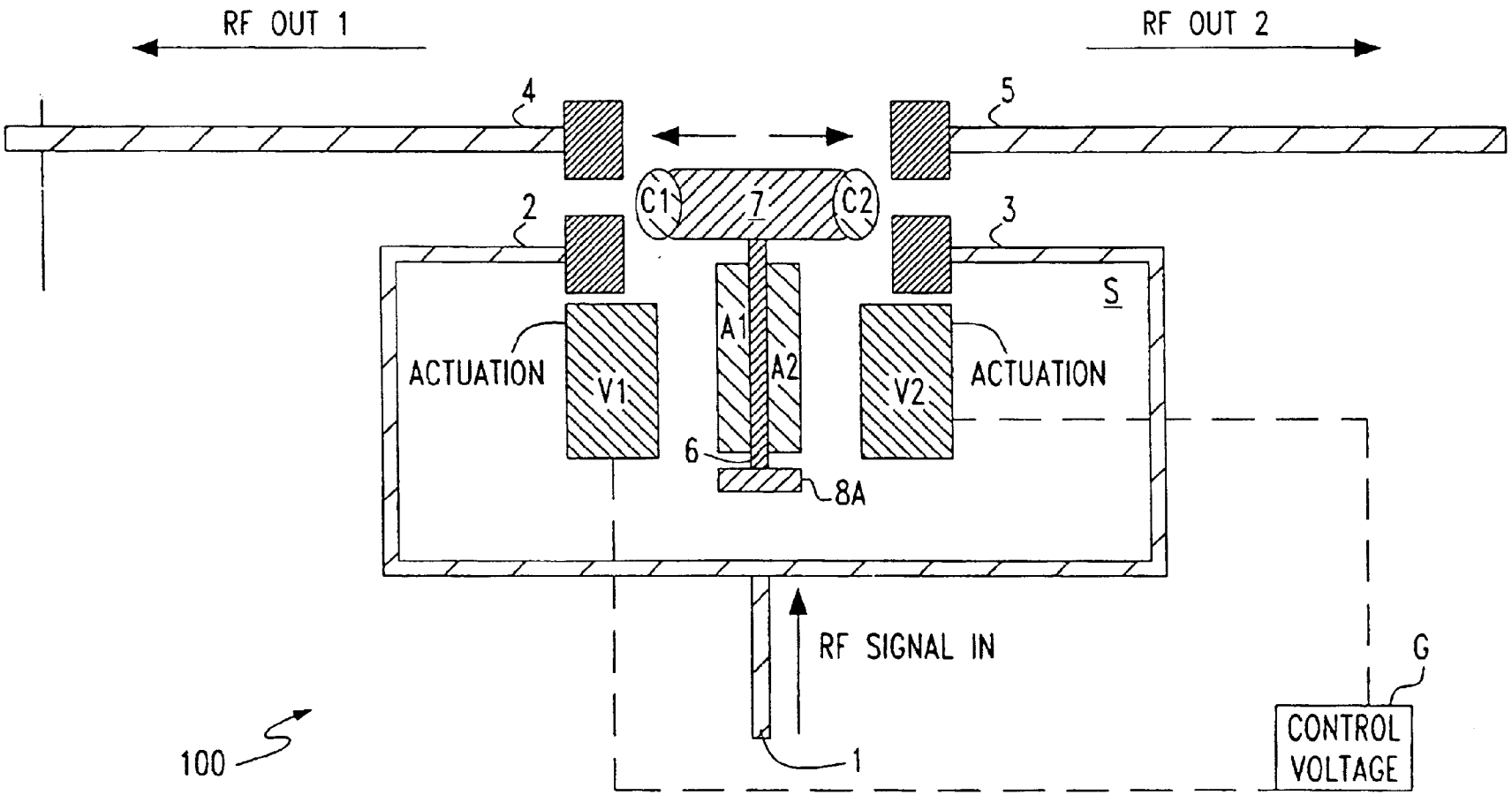

The present invention relates to switches and, more particularly, to microelectromechanical system (MEMS) switches.

2. Description of the Prior Art

MEMS switches use electrostatic actuation to create movement of a beam or membrane that results in an ohmic contact (i.e., an RF signal is allowed to pass-through) or in a change in capacitance, by which the flow of the RF signal is interrupted.

In a wireless transceiver, p-i-n diodes or GaAs MESFET's are often used as switches, however, these have high power consumption rates, high losses (typically 1 dB insertion loss at 2 GHz), and are non-linear devices. MEMS switches, on the other hand, have demonstrated an insertion loss less than 0.5 dB, are highly linear, and have very low power consumption because they use a DC voltage for electrostatic actuation. If the actuators are coupled to the RF signal in a series switch (i.e., ohmic contact), then the DC bias would need to be decoupled from the RF signal. Usually, the DC current for the p-i-n diodes in conventional switches is handled in the same way. Decoupling is never 100%, and there are always some losses to the RF signal power either by adding resistive losses or by direct leakage.

Another source of losses is capacitive coupling of the actuators to the RF signal, especially when a series switch is closed. If high power is fed through the switch, then a voltage drop as high as 10V can be associated with the RF signal. That voltage is present at the RF electrode of the series switches in the open state. If these electrodes are also part of the closing mechanism (by comprising one of the actuator electrodes), that could cause the switches to close (hot switching) and, thus, limit the switch linearity (generate harmonics, etc.) This is a known problem for transistor switches such as CMOS or FET switches. Thus, to minimize losses and improve on a MEMS switch linearity, it is important to separate entirely the RF signal electrodes from the DC actuators.

Another reason to separate the DC actuators of the switch beam from the RF signal electrode is the need to design single-pole-multi-throw switches for transmit/receive or frequency selection wireless applications. Integrating two or N number of switches in parallel provides a multiple throw switch with N number of throws.

The multi-throw designs are important in commercial wireless applications for multiple frequency and band selection. For example, GSM has typically three frequencies and, thus, a single-pole-four-throw MEMS switch will enable transmit/receive and frequency selection. In addition, if two different protocols are used such as GSM and UMTS, then a double-pole-N-throw switch may be used.

U.S. Pat. No. 6,218,911 B1, incorporated in its entirety herein, describes a lateral MEMS switch and a process of fabrication relying on a single metallization level. A drawback of the lateral switch design described in U.S. Pat. No. 6,218,911 B1 is that the switching element experiences a high level of stress because of the deflection or bending required to close the electrical switch circuit. Such repeated operation of the MEMS switch to more than one billion cycles, will tend to cause fatigue of the metallic materials of the element that are deflected.

SUMMARY OF THE INVENTION

The present invention describes the design of a single-pole or double-pole multi-throw microelectromechanical switch for RF applications that can operate with a low actuation voltage, and that has a very low insertion loss and high isolation. The lateral actuation used in this MEMS switch design can use a low actuation voltage without the need to fabricate very small vertical gaps that are challenging to reproduce and also provide design trade-off in terms of isolation. A small or short lateral movement of the switch element (movable part) causes an almost stress free closure of the switch. The lateral switch has improved reliability because of the small movement required and the low stress imposed on the switching element (movable part).

According to the present invention, a MEMS switch includes a substrate, an elongated movable part, a pair of electrical contacts disposed at one side of the part, an actuation electrode disposed at the one side of the part and separated from the pair of electrical contacts, wherein the part, the contacts and the electrode are disposed on the substrate, wherein the elongated movable part is arranged and dimensioned such that the part is movable in a generally lateral direction toward the contacts, and wherein the movable part includes a central elongated member fixed to a head having an electrical contact disposed at the one side.

The invention also includes anchoring arrangements that are almost stress-free and that allow the switching element to move laterally either through a pivot point or through use of a bracket-like structure to constrain the movement of a free-free beam.

It is a principal object of the present invention to provide a MEMS switch having a movable element which undergoes less mechanical stress in operation than known MEMS switches.

Further and still other objects of the present invention will become more readily apparent from the following detailed description is taken in conjunction with the accompanying figures.

BRIEF DESCRIPTION OF THE DRAWING FIGURES

FIG. 1A is a top plan schematic view of a first embodiment of the invention connected to a central or actuation voltage generator G.

FIGS. 1*b*, 1*c*, 1*d* and 1*e* are side schematic views of various anchor arrangements which can be used in the present invention.

Figure 3:
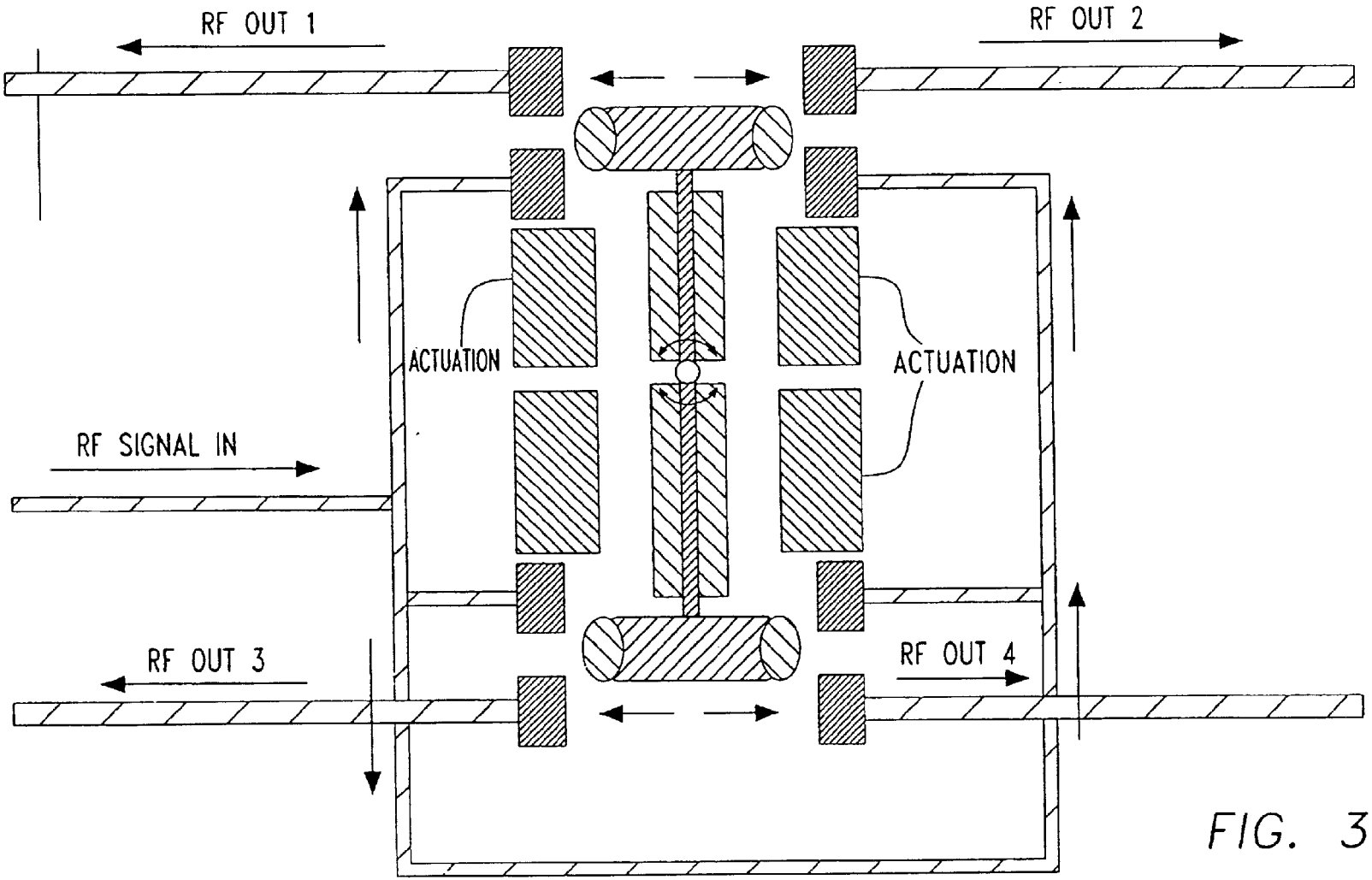
Figure 4:
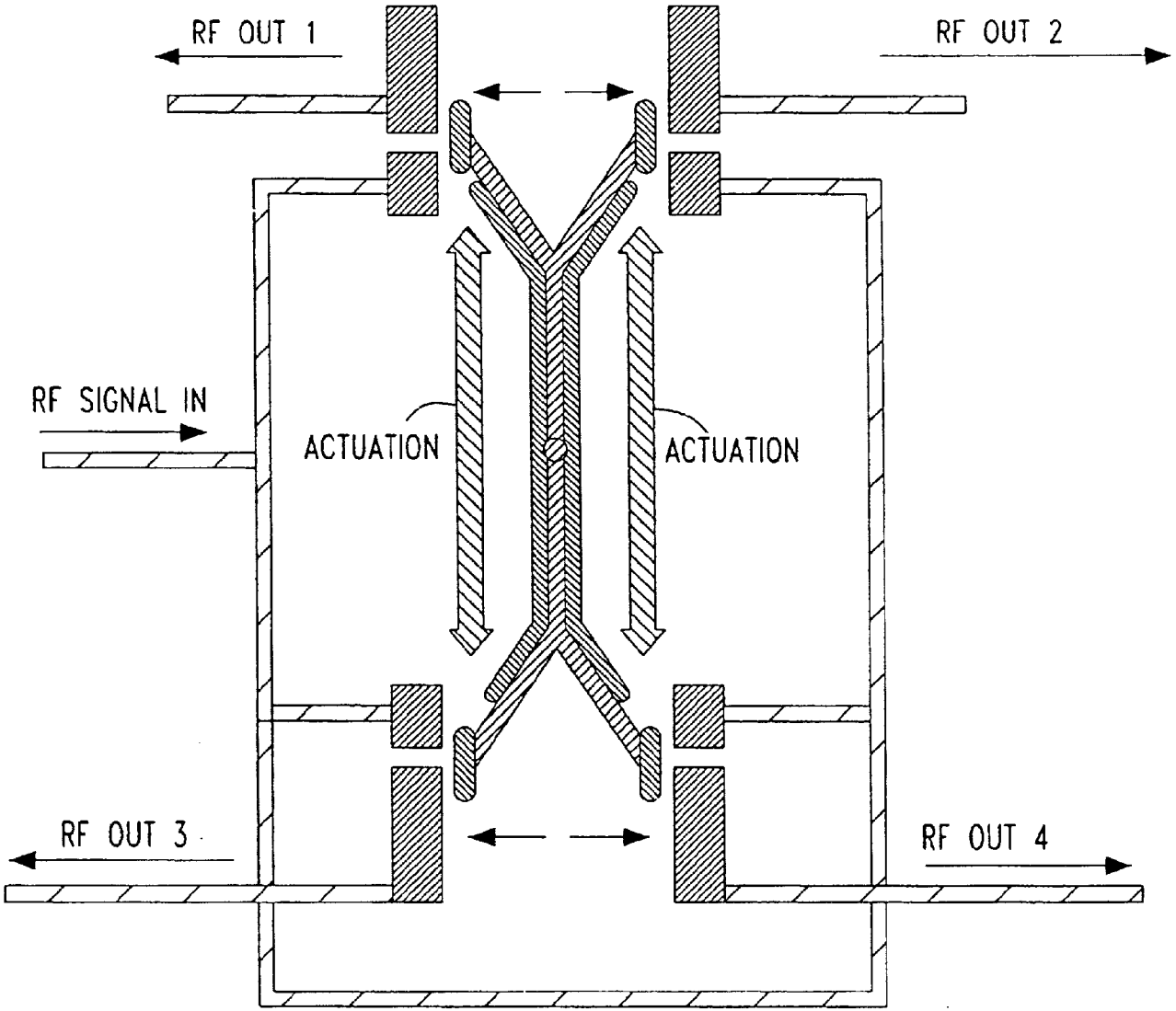
Figure 5:
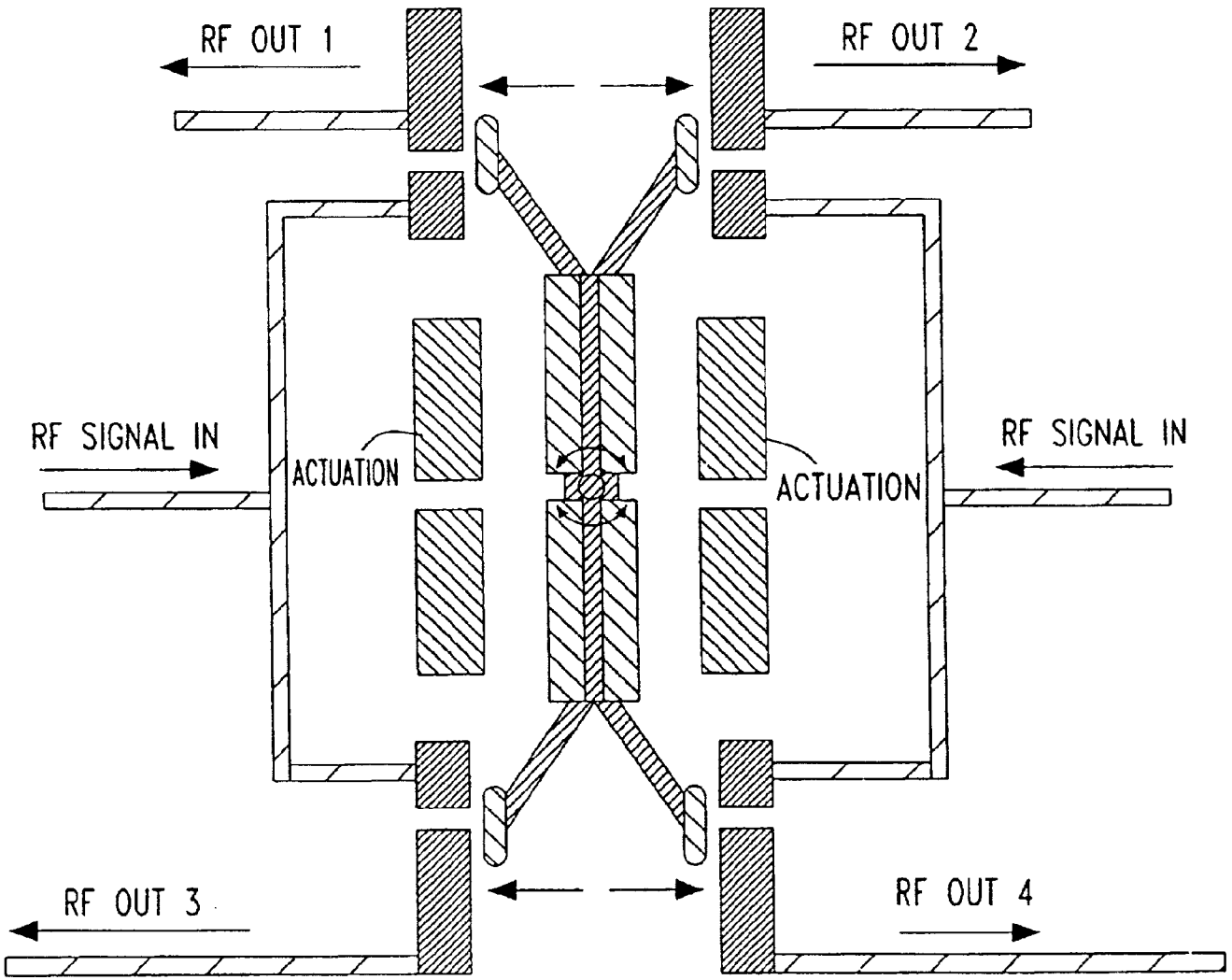

FIGS. 3, 4, and 5 are top plan schematic views of further alternative embodiments of the present invention.

DESCRIPTION OF THE PREFERRED EMBODIMENTS AND BEST MODE

FIG. 1 shows a top-plan view of a series lateral MEMS switch 100 according to a preferred embodiment of the invention, connected to a control signal (e.g., voltage) generator G. The lateral switch includes an insulating long arm 6, that is connected (e.g., fixed) to "hammer"-shaped arm 7 provided with two metallic contacts C1,C2. The structure 6,7 is free to move about laterally in directions of an Arrow, and the longer the center arm 6, the less stress at a location of an anchor 8A.

The beam 6 is anchored on one side by means of the anchor arrangement 8A and is free to move about laterally. The beam 6 has two conductive electrodes A1,A2 provided on both sides that are kept at ground. If a positive potential V is applied on electrode V1, then an attractive electrostatic force develops between V1 and A1 and as a result, the hammer shaped arm will tend to move laterally toward contacts 2, 4. If C1 is a metal, then an ohmic contact will be established between 2, 4 and C1. When an RF or AC signal is fed through line 1, then when the switch 100 is closed through 2, C1 and contact and line 4, this will allow the RF signal to pass through contact and line 4. Alternatively, the contact C1 could be a dielectric material. In this case, a series capacitive switch will be realized. Similarly, if a positive potential V is applied on V2 while A2 is kept at ground, then the switch 100 will tend to close between contact and line 3, C2 and contact and line 5, thereby creating a single-pole (single input) double throw (double output RF switch). If the electrodes V1, V2 are kept at the same potential versus ground, then the beam 6 and arm (head) 7 will not move.

There are many advantages that the lateral switch offers. First, there is an equilibrium position of the switch when the actuation electrodes V1, V2 are at the same potential versus ground. This allows controlled movement of the beam 6 and head 7. Second, a small movement of the beam 6, creates larger lateral displacement of the head 7, thereby placing low-stress on the switch element (movable part). This alone may assure long-term reliability of switch operation for the many billion cycles needed for wireless applications without mechanical failures of joints, anchors and fatigue of materials. Third, the curvature in the contacts C1,C2 allows the formation of a reliable contact on a few points and the effective passage of the RF signal from point 2 to point 4 or point 3 to point 5. In addition, the movement of arm or head 7, yields a high contact force for the contacts C1,C2. High contact force along with the choice of appropriate contact materials has been found to be important elements for low contact resistance MEMS switches.

In this invention, the layered contacts A1,A2 are thin films of W, Ta, Ti, their nitrides, Cu, Ag, Al or Ni, Fe, NiFe, Co, Mo, Sn, Pb or noble metals such as Au, Ru, Re, Rhodium, Pt, Pd. The Beam 6 and the head 7 are formed of insulators such as SiO2, SiN, Silicon oxynitride, or elastomeric type materials. The contacts C1,C2 and 3, 5, 2 and 4 are formed of noble metals such as Au, Pt, Pd, Rhenium, Ruthenium, Rhodium, Iridium. Different noble metals may be used on both sides of the contacts to minimize stiction. Actuation electrodes V1,V2 are typically thick to ensure a large overlap area with A1 and A2, therefore metal films that can be electroplated will be used for V1, V2 such as Ni, Fe, Co, Ag, Pt, Pd, Au, Cu, Ruthenium, Rhodium. During fabrication of a device 100 according to the invention, a sacrificial material M is etched by a plasma process to release the beam (or movable part) free. The material is, e.g., an organic based material such as hydrogenated carbons, polyimides, polyaromatic esters, and photoresists. See FIGS. 1*b, c. d* and *e.*

Figure 1B:
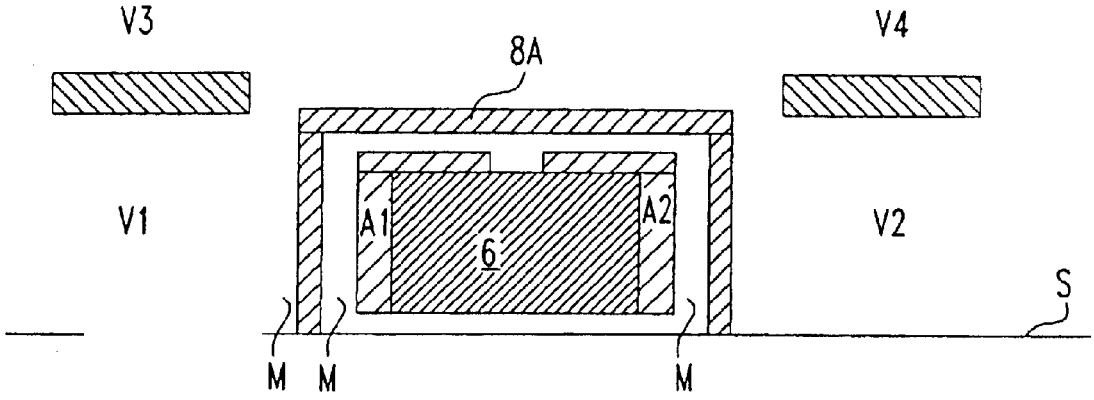

This etching permits different anchoring arrangements: FIG. 1*b* shows a free-free beam 6 with attached thin metal films A1 and A2. A1 and A2 span the side of beam 6 but also cover part of the top surface. Beam 6 is confined at one end on all four sides by a bracket 8A; see, FIG. 1*b*. The free-free beam 6 may be raised above the substrate S using, e.g., electrodes V3 and V4 (not shown in FIG. 1) and the corresponding electrodes A1 and A2. To move the beam laterally, electrodes V1 or V2 are used. If the applied potential on V1 is positive, then the beam 6 will tend to move to the left making contact between 2, C1 and 4. If the applied voltage on V2 is positive, then the beam will move to the right making contact between 3, C2 and 5.

Figure 1C:
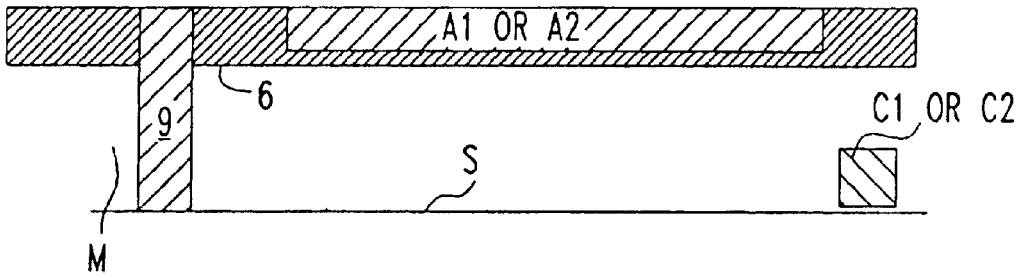
Figure 1D:
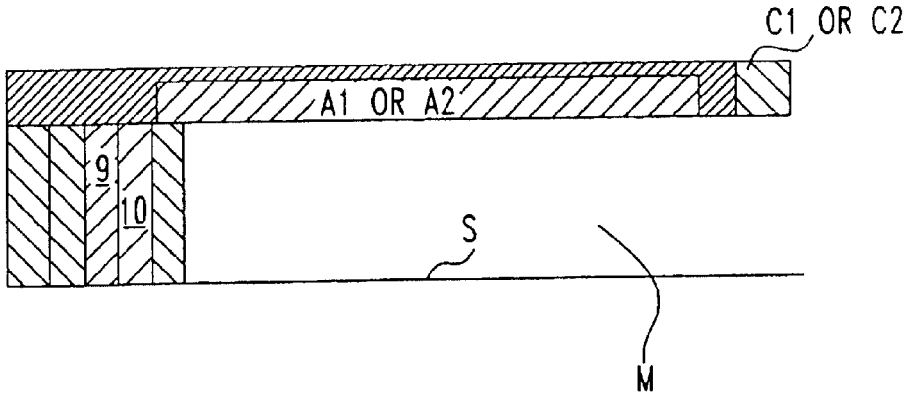
Figure 1E:
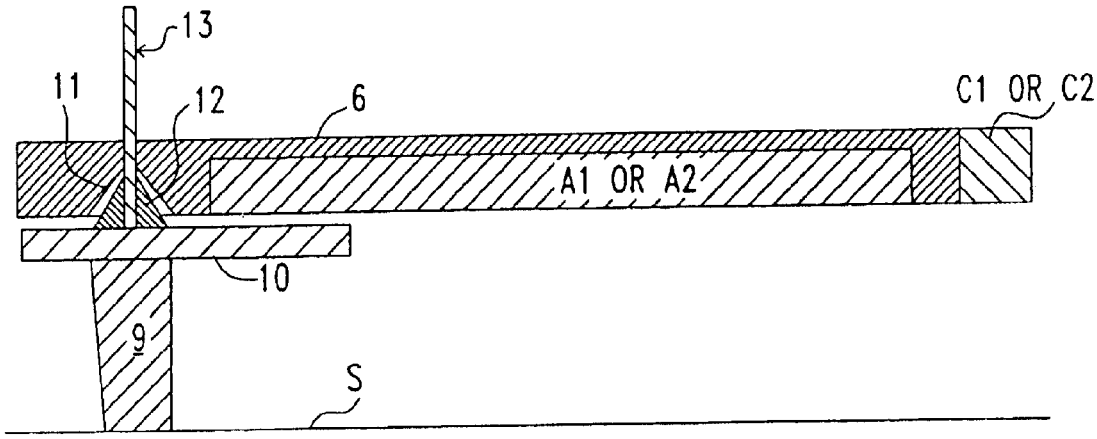

FIG. 1*e* shows an alternative anchoring scheme using a pivot point. The pivot 9 is achieved using a single metal filled via that connects beam 6 to the substrate. The pivot connection allows the beam to move laterally with less stress than a fully anchored cantilever-type beam as shown in FIG. 1*e*. FIG. 1*c* shows a metal pin 9 disposed in a slot of the beam 6, to permit lateral motion of the beam 6.

Figure 2:
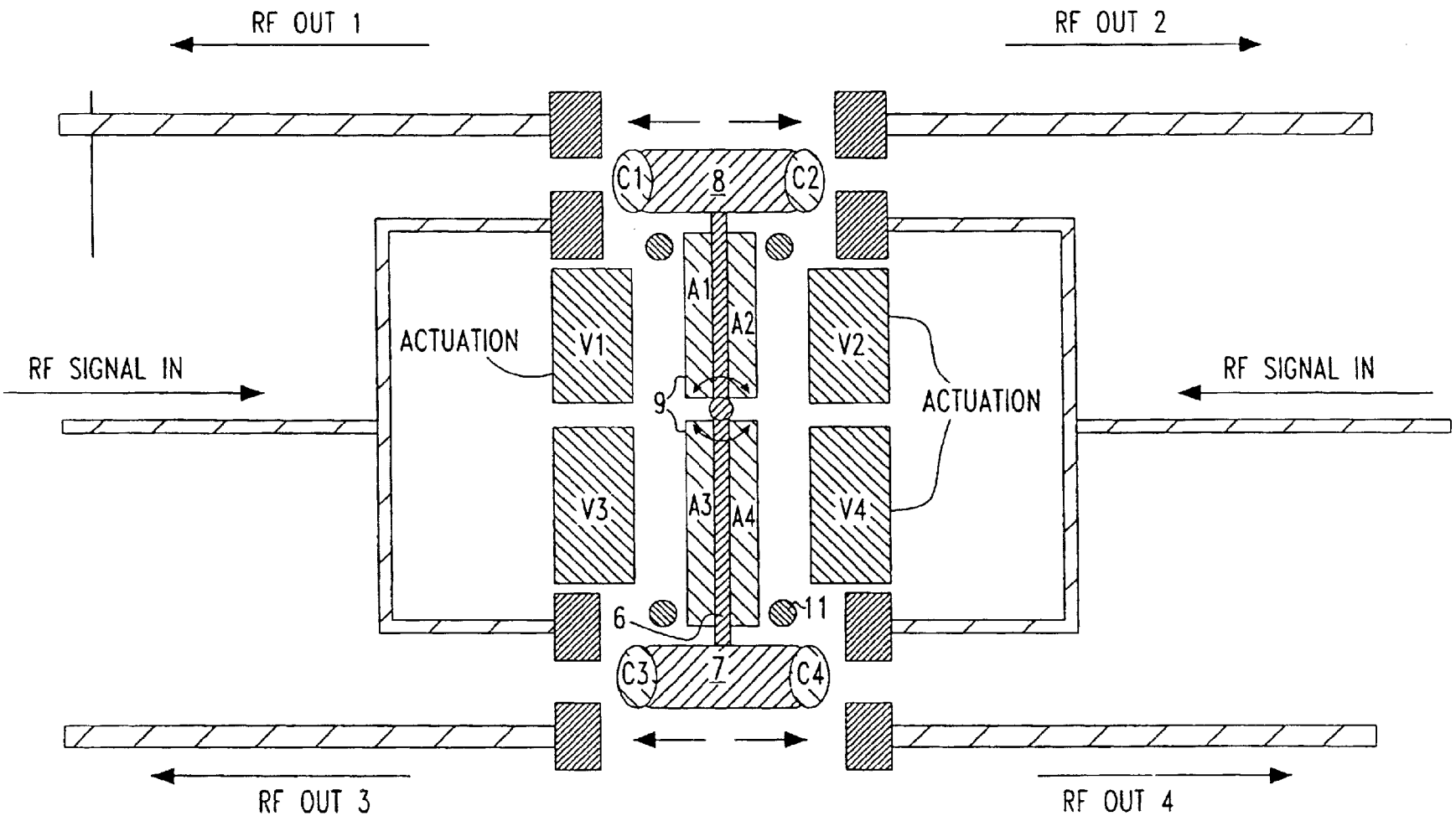

FIG. 2 shows a double-pole-four-throw MEMS switch. Beam 6 is long and anchored through pivot point 9. A positive electrostatic potential applied on V4 and V1 versus ground will create a movement of the switch to close contacts C1 and C4. FIG. 3 shows a modification of the MEMS switch of FIG. 2 because the RF signal is only fed from a single line. FIG. 4 and FIG. 5 show additional alternative embodiments, which are self-explanatory to those skilled in the art in view of the instant disclosure.

Various known processes and techniques to fabricate the device 10 can be used, such as deposition, damascene, etching, patterning, etc., all as would be well understood to those skilled in view of the present disclosure.

In one preferred embodiment of the switch 100 according to the present invention, the following dimensions are used: longitudinal length of beam 6 is a length in a range of approximately (±10%) 10 to approximately 100 microns; longitudinal length of head 7 is in a range of approximately 10 to approximately 50 microns, while its width (diameter) is in a range of approximately two to approximately 10 microns; maximum distance between closest surface of electrode V1 and closest surface of thin film electrode A1 is in range of approximately one to 10 microns; same distances between V2 and A2; maximum distance between C1 and contacts 2,4 is approximately one—5 microns; same distances between C2 and contacts 3,5.

Overlapping portions of V1 and A2 are each approximately 50 square microns to approximately 2500 square microns. Desired control voltages from generator G in a range of approximately 1 to 20 volts, depending on the dimensions and materials used for the MEMS switch 100.

While there has been shown and described what is at present considered preferred embodiments of the present invention, it will be appreciated by those skilled in the art that various changes and modifications may be made therein without departing from the spirit and scope of the present invention.

What is claimed is:

1. A switch, comprising:

a substrate;

an elongated movable part;

a pair of electrical contacts disposed at one side of said part;

an actuation electrode disposed at said one side of said part and separated from said pair of electrical contacts;

wherein said part, said contacts and said electrode are disposed on said substrate, wherein said elongated movable part is arranged and dimensioned such that said movable part is movable a lateral direction generally toward said contacts, and wherein said movable part includes a central elongated member fixed to a cylindrical-shaped head having an electrical contact disposed at said one side, said electrical contact contacting said pair of electrical contacts during a normal operation of said switch.

2. The switch as claimed in claim 1, wherein said central elongated member includes thin-film electrically conductive materials provided on an elongated insulating member.

3. The switch as claimed in claim 1, further comprising another pair of electrical contacts disposed at another side of said part opposite said one side.

4. The switch as claimed in claim 1, wherein said head includes another electrical contact disposed at another side of said part.

5. The switch as claimed in claim 1, wherein said head comprises a central insulating material, said contact being disposed at one end of said material.

6. The switch as claimed in claim 1, wherein said elongated insulating member comprises an insulator, the insulator being selected from the group consisting of $SiO_2$, SiN, Silicon Oxynitride, SiON, $Al_2O_3$, AlN, $TiO_2$, $ZrO_2$, $HfO_2$, $Ta_2O_5$, TaON, and other High k and Low k dielectric constant materials.

7. The switch has claimed in claim 1, wherein said head comprises an elastomeric material.

8. The switch as claimed in claim 1, wherein at least one of said electrical contacts is connected to a source of Rf signals.

9. The switch as claimed in claim 1, wherein said head comprises a central conductive material, and an insulating material disposed along a length of said conductive material.

10. The switch as claimed in claim 1, wherein said central elongated member includes thin-film electrically conductive materials provided on an elongated insulating member, and wherein said thin-film electrically conductive materials are selected from the group consisting of W, Ta, Ti, Cu, Ag, Al, Ni, Fe, NiFe, Co, Mo, Sn, and Pb.

11. The switch as claimed in claim 1, wherein said electrical contacts disposed at said one side are selected from the group consisting of Au, Pt, Pd, Phenium, Rutnenium, Rhodium and Iridium.

12. The switch as claimed in claim 1, wherein said activation electrode is selected from the group consisting of Ni, Fe, Co, Ag, Pt, Pd, Au, Cu, Ruthenium, and Rodium.

13. The switch as claimed in claim 1, further comprising an anchor, wherein said central elongated member has an end disposed at said anchor.

14. The switch as claimed in claim 1, further comprising another pair of electrical contacts being disposed at another side of said part.

* * * * *